US007501757B2

(12) United States Patent
Kang

(10) Patent No.: US 7,501,757 B2
(45) Date of Patent: Mar. 10, 2009

(54) PLASMA DISPLAY PANEL

(75) Inventor: Tae-Kyoung Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 496 days.

(21) Appl. No.: 11/124,143

(22) Filed: May 9, 2005

(65) Prior Publication Data

US 2005/0258751 A1 Nov. 24, 2005

(30) Foreign Application Priority Data

May 24, 2004 (KR) ..... 10-2004-0036835

(51) Int. Cl.
*H01J 17/49* (2006.01)

(52) U.S. Cl. ..... 313/582; 313/483; 445/24

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,194,333 | B1 * | 2/2001 | Ryu | 501/32 |
| 6,242,860 | B1 * | 6/2001 | Sasao et al. | 313/586 |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2001/0026255 | A1 * | 10/2001 | Sano et al. | 345/60 |
| 2002/0195936 | A1 * | 12/2002 | Kato et al. | 313/582 |
| 2004/0000870 | A1 * | 1/2004 | Kifune et al. | 313/582 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003 and Appendix A—Description of Technology, Annex B—Relationship Between Voltage Terms And Discharge Characteristics; Annex C—Gaps and Annex D—Manufacturing.

*Primary Examiner*—Peter Macchiarolo
*Assistant Examiner*—Donald L Raleigh
(74) *Attorney, Agent, or Firm*—Robert E. Bushnell, Esq.

(57) ABSTRACT

A plasma display panel (PDP) designed to reduce the amount of external light that is reflected. This is accomplished by having some phosphor material on portions of the tops of the barrier ribs outside the discharge cells. Since the reflectance of the barrier rib material is higher than that of phosphor material, such a design will reduce the amount of external light reflected off the screen of a plasma display panel. By reducing external light reflection, the contrast of the image is improved. This can be achieved while still preventing crosstalk between neighboring discharge cells.

19 Claims, 2 Drawing Sheets

U.S. PATENT DOCUMENTS

2004/0168630 A1* 9/2004 Suzuki et al. ..... 118/300

FOREIGN PATENT DOCUMENTS

JP 2845183 10/1998
JP 2917279 4/1999
JP 2001-043804 2/2001
JP 2001-325888 11/2001

* cited by examiner

PLASMA DISPLAY PANEL

CLAIM OF PRIORITY

This application makes reference to, incorporates the same herein, and claims all benefits accruing under 35 U.S.C. §119 from an application PLASMA DISPLAY PANEL earlier filed in the Korean Intellectual Property Office on 24 May 2004 and there duly assigned Serial No. 10-2004-0036835.

BACKGROUND OF THE INVENTION

1. Field of the Invention

The present invention relates to a plasma display panel, and more particularly, to a plasma display panel having a structure that can improve contrast by reducing reflective brightness from external light.

2. Description of the Related Art

A plasma display panel (PDP) displays images by exciting phosphor layers formed in a predetermined pattern with ultraviolet rays that are generated from a glow discharge. The glow discharge occurs when a predetermined voltage is applied to electrodes formed is a closed space where a discharge gas is filled.

PDPs can be classified into direct current PDP, alternating current PDP, and hybrid PDP according to driving methods. PDPs can be further classified into those having a minimum of two electrodes and those having a minimum of three electrodes. A direct current PDP includes address electrodes that increase addressing speed by performing an address discharge and a sustain discharge separately. Alternating current PDPs can be divided into those with an opposing discharge electrode structure and those with a surface discharge electrode structure according to the disposition of the electrodes. In the opposing discharge electrode structure, a discharge occurs in a direction perpendicular to the PDP by applying a potential difference to two sustain electrodes on different substrates. In the surface discharge electrode structure, a discharge occurs on one surface of a substrate by having both sustain electrodes on the same substrate.

In PDPs, reflective brightness of external light is an important factor affecting performance. Reflective brightness is from light external to the PDP that reflects off the display of the PDP during operation of the PDP. The more reflective brightness there is, the poorer the image quality becomes. The brightness and contrast of the PDP are reduced if the reflective brightness is increased. The reflective brightness can be further increased if a white pigment, such as $TiO_2$, is added to a barrier rib to effectively reflect light emitted from a phosphor layer. Therefore, there is a need to reduce the reflective brightness. A conventional method of preventing the reflection involves placing a black stripe that can block external light on a non-discharge region of the PDP. A problem with incorporating the black stripe into the design of a PDP is that several extra manufacturing steps are required to make a PDP having the black stripe. For example, the black stripe material must be applied or deposited on the structure somehow. Then the black stripe material has to be patterned. All of these extra steps can be extremely expensive in a manufacturing production environment. Therefore, what is needed is a more effective solution to the reflection of external light problem that both results in an effective PDP structure that is also inexpensive, simple and easy to make.

SUMMARY OF THE INVENTION

It is therefore an object of the present invention to provide an improved design for a PDP.

It is also an object of the present invention to provide a design for a PDP that results in less reflective brightness.

It is further an object of the present invention to provide a design for a PDP that provides improved image quality.

It is yet another object of the present invention to provide a design for a PDP that results in improved contrast of the displayed image.

It is still an object of the present invention to provide a design for a PDP that reduces the reflection of external light that is easy to make.

It is also an object of the present invention to provide a design for a PDP that is easy and inexpensive to make and manufacture.

It is yet an object of the present invention to provide a design for a PDP that is inexpensive and simple to make.

It is further an object of the present invention to provide a design for a PDP that is both effective at reducing or eliminating the reflection of external light off the screen and is easy to make and does not result in extra process steps.

These and other objects can be achieved by a PDP with phosphor layers located in some of the non-discharge regions. The PDP has an upper substrate, an upper dielectric layer formed on the upper substrate, a lower substrate facing the upper substrate, a lower dielectric layer formed on the lower substrate and facing the upper dielectric layer, a plurality of barrier ribs that define discharge cells between the upper substrate and the lower substrate, a plurality of sustain electrode pairs located within the upper dielectric layer corresponding to the discharge cells, a plurality of address electrodes located within the lower dielectric layer corresponding to the discharge cells, and disposed perpendicularly to the sustain electrode pairs, a plurality of main phosphor layers producing red, green, and blue light located in the discharge cells, and a plurality of dummy phosphor layers at least partially connected to the main phosphor layers by connector layers. The dummy phosphor layers covers some of the exposed portions of the barrier ribs. Since the phosphor material reflects less light than the barrier rib material, such a design reduces external light reflection thus improving contrast and overall image quality for the PDP. Unlike employing a black stripe, the present design is easy to make and does not require extra process steps.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
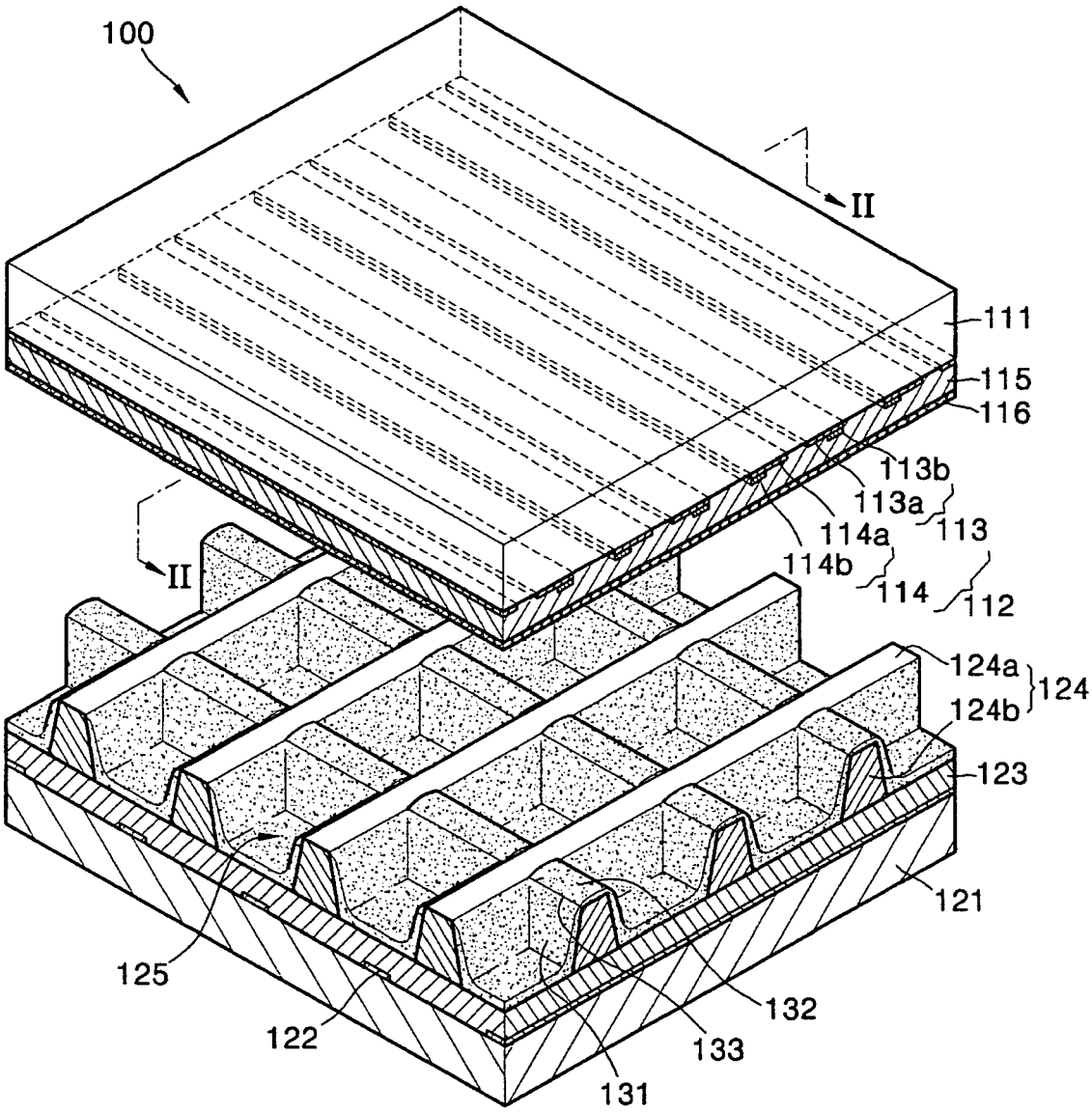
FIG. 1 is a perspective view of a plasma display panel (PDP) according to an embodiment of the present invention.
Figure 2:
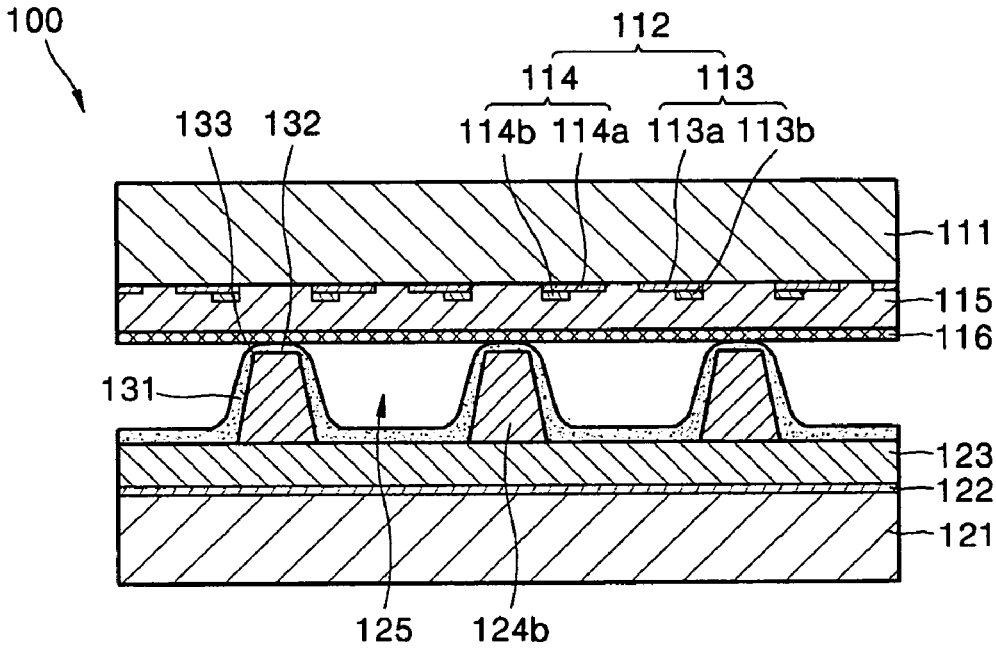
FIG. 2 is a cross-sectional view taken along line II-II of FIG. 1.

Turning now to the figures, FIG. 1 is a perspective view of a plasma display panel (PDP) 100 according to an embodiment of the present invention and FIG. 2 is a cross-sectional view taken along line II-II of FIG. 1. Referring to FIGS. 1 and 2, the PDP 100 includes an upper substrate 111 on which an image is displayed and a lower substrate 121 facing the upper substrate 111. A plurality of sustain electrode pairs 112 are arranged on a surface of the upper substrate 111 facing the lower substrate 121. Each of the sustain electrode pairs 112 includes an X electrode 113 and a Y electrode 114, and the X and the Y electrodes 113 and 114 can respectively corresponded to a common electrode and a scan electrode.

The X and Y electrodes 113 and 114 respectively include transparent electrodes 113*a* and 114*a* and bus electrodes 113*b* and 114*b* connected at sides of the transparent electrodes 113*a* and 114*a*. Each of the transparent electrodes 113*a* and 114*a* has a stripe shape, and the bus electrodes 113*b* and 114*b* also have stripe shape but with a narrower width than the transparent electrodes 113*a* and 114*a*. A gap between ends of the transparent electrodes 113*a* and 114*a* defines a discharge gap, and bus electrodes 113*b* and 114*b* are located on sides of transparent electrodes 113*a* and 114*a* opposite from the discharge gap. Therefore, as depicted in FIG. 2, the sustain electrode pairs 112 are located to correspond to the discharge cells 125.

The transparent electrodes 113*a* and 114*a* are formed of a transparent conductive material, such as indium tin oxide (ITO), to allow visible light to pass through. The bus electrodes 113*b* and 114*b* apply a voltage to the transparent electrodes 113*a* and 114*a*, and serve to reduce any voltage drop along the transparent electrodes 113*a* and 114*a*. The bus electrodes 113*b* and 114*b* are formed of a material having high conductivity, such as Ag or Cu, to improve the electrical conductivity along the transparent electrodes 113*a* and 114*a* since the transparent electrodes 113*a* and 114*a* are formed of ITO which has a lower electrical conductivity than Ag or Cu.

In the drawing, the transparent electrodes 113*a* and 114*a* have a stripe shape, but the present invention is not limited thereto. Also, the X electrode and the Y electrode can instead be made of only the transparent electrodes or alternatively of only the bus electrodes.

The sustain electrode pairs 112 are covered by an upper dielectric layer 115 formed on the upper substrate 111. The upper dielectric layer 115 is, in turn, covered by a protective layer 116 made of MgO.

Address electrodes 122 are formed on a surface of the lower substrate 121 facing the upper substrate 111 and extend perpendicular to the sustain electrode pairs 112. The address electrodes 122 have a striped shape and are located to correspond to the discharge cells 125 and are formed below the discharge cells 125. The address electrodes 122 are covered by a lower dielectric layer 123 formed on the lower substrate 121.

Barrier ribs 124 are formed on the lower dielectric layer 123. The barrier ribs 124 partition a space between the upper substrate 111 and the lower substrate 121 into the discharge cells 125. The barrier ribs 124 are made up of first barrier ribs 124*a* spaced apart by predetermined intervals and second barrier ribs 124*b* that intersect the first barrier ribs 124*a*. The first barrier ribs 124*a* extend parallel to each other and are located between adjoining or neighboring address electrodes 122. In the figures, the first barrier ribs 124*a* run parallel to the address electrodes 122, but the present invention is in no way limited to as such. Also, the figures show the second barrier ribs 124*b* as running orthogonal to the address electrodes 122 and parallel to the sustain electrode pairs 112, but the present invention is in no way limited to as such. For example, the barrier ribs 124 could instead have a delta shape and still be within the scope of the present invention.

The discharge cells 125 have four side surfaces and are arranged in a matrix defined by the first and second barrier ribs 124*a* and 124*b*, and cross talk between the discharge cells 125 is prevented. When the discharge cells 125 are defined in a matrix, fine pitch and high brightness can be achieved. The discharge cells 125 are filled with a discharge gas such as Ne mixed with Xe. The upper substrate 111 and the lower substrate 121 are sealed together by a sealing member such as frit glass applied along the edges of the upper and lower substrate 111 and 121 with the discharge cells 125 being filled with the discharge gas.

A main phosphor layer 131 is located within the discharge cells 125 on side surfaces of the barrier ribs 124 and on an upper surface of the lower dielectric layer 123. The main phosphor layer 131 is made up of phosphor materials that produce red, green, and blue light to produce a visible color image. The main phosphor layer 131 can include a red main phosphor layer, a green main phosphor layer, and a blue main phosphor layer according to the emitted color from a fluorescent material. The discharge cells 125 in which of the main phosphor layers 131 producing red, green, and blue light are made respectively form red, green, and blue sub-pixels which make up a unit pixel by forming pairs.

According to an aspect of the present invention, dummy phosphor layers 132 are formed on least on a portion of an upper region of the barrier ribs 124. More specifically, the main phosphor layer 131 is found within the discharge cells 125 and extend in a direction parallel to the address electrode 122 and produce one of red, green, and blue light. In a sense, the dummy phosphor layers 132 produce colors identical to that of adjacent main phosphor layers 131 and are located on the upper surfaces of the second barrier ribs 124*b*.

The main phosphor layers 131 and the dummy phosphor layers 132 with identically emitted colors are placed along a direction parallel to that of the address electrode 122. With such a configuration, the neighboring discharge cells 125 in this address electrode direction do not affect each other when the second barrier rib 124*b* is a boundary. This is because phosphor layers on either side of second barrier rib 124*b* produce the same colors. Thus, discharge cells 125 consecutively arranged in parallel to the address electrodes to not affect each other. On the other hand, the dummy phosphor layers 132 are not formed on the upper surfaces of the first barrier ribs 124*a*. Thus, discharge cells on opposite sides of the first barrier ribs 124*a* do not affect each other. If the dummy phosphor layers 132 were to be formed on the upper surfaces of the first barrier ribs 124*a*, cross talk would occur between the neighboring discharge cells 125 on opposite sides of first barrier ribs 124*a* because they are of different color.

Figure 3:
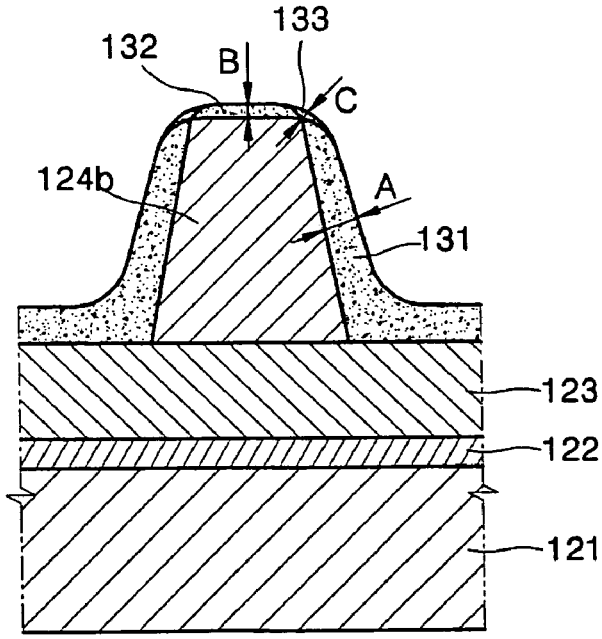
FIG. 3 is a partial cross-sectional view illustrating a phosphor layer on the barrier rib of FIG. 2.

The thickness of the dummy phosphor layer 132 is preferably less than the thickness of the main phosphor layer 131. If the thickness of the dummy phosphor layer 132 is too thick, there is a high possibility of generating cross talk between the discharge cells 125 due to the dummy phosphor layer 132 interposed between the discharge cells 125. Here, the thickness A of the main phosphor layer 131 is defined from the center of a side surface of the second barrier rib 124*b* to an outer surface of the main phosphor layer 131, as illustrated in FIG. 3. The thickness B of the dummy phosphor layer 132 is defined from the center of an upper surface of the second barrier rib 124*b* to an outer surface of the dummy phosphor layer 132 as also illustrated in FIG. 3. One example would be to make the main phosphor layer 131 approximately 10-30 um thick and the dummy phosphor layer 132 to be 3-10 um thick.

Referring to FIG. 3, a connector phosphor layer 133 is positioned between the main phosphor layer 131 and the dummy phosphor layer 132 to connect the main phosphor layer 131 to the dummy phosphor layer 132. The connector phosphor layer 133 may be curved to connect the main phosphor layer 131 to the dummy phosphor layer 132 smoothly and continually around an upper edge of the second barrier rib 124*b*.

The connector phosphor layer 133 prevents a portion of the second barrier rib 124*b* between the main phosphor layer 131 and the dummy phosphor layer 132 from being exposed to external is light. Therefore, this portion of the second barrier rib 124*b* is covered by connector phosphor layer 133 so that no portion of second barrier rib 124*b* is exposed to external light. By covering the second barrier rib 124*b* as so, less of the barrier rib 124 is exposed to external light. This is important because the barrier ribs 124 are more apt to reflect external light than the phosphor layers, and if more of the barrier ribs 124 are covered by a phosphor layer, less external light is reflected, leading to improved image contrast and an improved overall image quality.

As with the dummy phosphor layer 132, if the connector phosphor layer 133 is too thick, there is a possibility of generating cross talk between the discharge cells 125. In the present embodiment, the maximum thickness of the connector phosphor layer 133 is less than the thickness A of the main phosphor layer 131. Here, the maximum thickness C of the connector phosphor layer 133 is defined from an upper corner of the second barrier rib 124*b* to an outer surface of the connector phosphor layer 133.

The main phosphor layer 131, the dummy phosphor layer 132, and the connector phosphor layer 133 can be formed by a method such as using a dispenser. External light incident the second barrier rib 124*b* will result in minimal reflection since the second barrier rib 124*b* is entirely covered by the main phosphor layer 131, the dummy phosphor layer 132, and the connector phosphor layer 133, resulting in improved image contrast. The improved image contrast is brought about because the main phosphor layer 131, the dummy phosphor layer 132, and the connector phosphor layer 133 are made of a material that has a lower reflectance than that of the barrier rib 124. The barrier rib 124 is formed of $SiO_2$, PbO, $B_2O_3$, $Al_2O_3$, $TiO_2$, CaO, or ZnO, and is white and thus reflects nearly all incident light due to uniformly arranged fine particles. The phosphor particles that make up the main phosphor layer 131, the dummy phosphor layer 132, and the connector phosphor layer 133 reflect red, green and blue light and has a predetermined surface roughness. Thus, this phosphor material reflects less incident light than the material used in the barrier ribs 124. Dummy barrier ribs, which are non-discharge portions, may be further formed on the outermost surfaces of the barrier ribs that define the discharge cells. Dummy phosphor layers as described above may be formed on at least a surface portion of the dummy barrier ribs.

It is to be appreciated the advantages of the present invention, over that of a black stripe or a black matrix, in reducing external reflectance and improving image contrast. In the present invention, unlike the implementation of the black stripe or black matrix layer, a separate layer and thus separate process steps are not necessary. The dispenser can form the main phosphor layers 131 along with the dummy phosphor layers 132 and the connector phosphor layers 132 in one single swath. Extra application and patterning steps for an additional layer are thus avoided by the design of the present invention, while improving the image contrast. Thus, as compared with the black matrix and the black stripe designs, the design of the present invention is not only effective in reducing the reflection of external light, the design of the present invention is also easy to make and does not involve extra process steps, thus being simple and inexpensive to manufacture. It is this combination of reducing the reflection of external light and the absence of additional process steps that makes the design of the present invention superior over other designs used to reduce the reflection of external light.

The operation of the PDP 100 will now be briefly described. First, an address discharge occurs when an address discharge voltage is applied between the address electrodes 122 and the Y electrodes 114. Then, a predetermined wall charge accumulates in the discharge cells 125. In this state, a sustain discharge occurs when a sustain discharge voltage is applied between the X electrodes 113 and the Y electrodes 114. The charged particles generated as a result of discharge collide with the discharge gas and produce ultra violet rays by forming a plasma. An image is displayed on the upper substrate 111 by the main phosphor layer 131 that is excited by the generated ultra violet rays. When the PDP 100 is operating, external light incident from the outside of the PDP 100 is prevented from reaching the second barrier ribs 124*b* and reflecting off the second barrier ribs 124*b* by the dummy phosphor layer 132 and the connector phosphor layer 133. Compared to the second barrier ribs 124*b*, a much smaller fraction of the light is reflected off the dummy phosphor layer 132 and the connector phosphor layer 133, thus reducing the reflection of the external light for the entire PDP.

According to the present invention, the reflection of external light off the second barrier rib 124*b* can be prevented by forming a dummy phosphor layer 132 on at least a part of an upper region of the second barrier rib 124*b* and forming a connector phosphor layer 133 between the dummy phosphor layer 132 and a main phosphor layer 131. The reflection of external light can be remarkably reduced by the inclusion of the dummy and the connector phosphor layers because phosphor reflects less light than the barrier rib. Accordingly, brightness of light reflected by the PDP can be reduced and contrast can be improved due to the reduction of reflected external light.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel (PDP), comprising: an upper substrate; an upper dielectric layer arranged on the upper substrate; a lower substrate facing the upper substrate; a lower dielectric layer arranged on the lower substrate and facing the upper dielectric layer; a plurality of barrier ribs arranged between the upper substrate and the lower substrate, the plurality of barrier ribs defining the plurality of discharge cells, the plurality of barrier ribs including a plurality of first barrier ribs and a plurality of second barrier ribs, each of the plurality of second barrier ribs extending in a direction that crosses ones of the plurality of first barrier ribs, each of the second barrier ribs includes sidewall portions and a top portion, each sidewall portion facing into ones of the plurality of discharge cells, each top portion facing the upper substrate and adapted to reflect external light; a plurality of main phosphor layers adapted to produce red, green, and blue light and being arranged within the discharge cells; and a plurality of dummy phosphor layers at least partially connected to the main phosphor layers by connector phosphor layers, the dummy phosphor layers and the connector phosphor layers being adapted to reduce an amount of external light reflected off the top portions of the second barrier ribs, a reflectance of the main phosphor layers, the dummy phosphor layers, and the connector phosphor layers is less than a reflectance of the barrier ribs.

2. The PDP of claim 1, wherein the top portions of the second barrier ribs are flat, wherein a sharp edge is arranged between ones of the top portions and corresponding ones of the sidewall portions of ones of the second barrier ribs.

3. The PDP of claim 1, wherein the dummy phosphor layers are arranged on the top portions of the second barrier ribs.

4. The PDP of claim 1, wherein each of the second barrier ribs are of a same height as each of the first barrier ribs.

5. The PDP of claim 1, the barrier ribs being comprised of $TiO_2$.

6. The PDP of claim 1, a thickness of a connector phosphor layers is less than a thickness of the main phosphor layers.

7. The PDP of claim 1, a thickness of the dummy phosphor layers is less than a thickness of the main phosphor layers.

8. The PDP of claim 7, a thickness of the connector phosphor layers is less than the thickness of the main phosphor layers.

9. A plasma display panel (PDP) comprising: an upper substrate; an upper dielectric layer arranged on the upper substrate: a lower substrate facing the upper substrate; a lower dielectric layer arranged on the lower substrate and facing the upper dielectric layer; a plurality of barrier ribs arranged between the upper substrate and the lower substrate, the plurality of barrier ribs defining the plurality of discharge cells, the plurality of barrier ribs including a plurality of first barrier ribs and a plurality of second barrier ribs, each of the plurality of second barrier ribs extending in a direction that crosses ones of the plurality of first barrier ribs, each of the second barrier ribs includes sidewall portions and a top portion, each sidewall portion facing into ones of the plurality of discharge cells, each top portion facing the upper substrate and adapted to reflect external light; a plurality of main phosphor layers adapted to produce red, green, and blue light and being arranged within the discharge cells; and a plurality of dummy phosphor layers at least partially connected to the main phosphor layers by connector phosphor layers, the dummy phosphor layers and the connector phosphor layers being adapted to reduce an amount of external light reflected off the top portions of the second barrier ribs, a reflectance of the main phosphor layers, the dummy phosphor layers, and the connector phosphor layers is less than a reflectance of the barrier ribs.

10. The PDP of claim 1, wherein the barrier ribs are comprised of a material selected from a group consisting of $SiO_2$, PbO, $B_2O_3$, $Al_2O_3$, $TiO_2$, CaO and ZnO.

11. The PDP of claim 1, further comprising a protection layer on a lower surface of the upper dielectric layer.

12. The PDP of claim 1, an upper surface of the first barrier ribs being absent of phosphor.

13. The PDP of claim 4, an upper surface of the first barrier ribs being absent of phosphor.

14. A plasma display panel (PDP), comprising: an first substrate; a second substrate facing the first substrate; a dielectric layer covering the second substrate; barrier ribs that are arranged between the first substrate and the second substrate and dividing a space between the first and the second substrates into a plurality of discharge cells; a phosphor layer formed on the dielectric layer and on portions of the barrier ribs, the phosphor layer including main phosphor layers arranged within the discharge cells and dummy phosphor layers arranged outside the discharge cells between the barrier ribs and the first substrate, the barrier ribs comprising first barrier ribs and second barrier ribs extending orthogonal to the first barrier ribs, the dummy phosphor layers being formed on a top portion of the second barrier ribs but not on top portions of the first barrier ribs, each second barrier rib comprising a sidewall portion and the top portion, and a sharp edge between the top portion and the sidewall portion, the phosphor layer also including connector phosphor layers covering the sharp edge, a reflectance of the main phosphor layers, the dummy phosphor layers, and the connector phosphor layers is less than a reflectance of the barrier ribs.

15. The PDP of claim 14, the second barrier ribs being of a same height as the first barrier ribs.

16. The PDP of claim 14, each of said discharge cells being bounded by ones of the first barrier ribs, ones of the second barrier ribs, the first substrate and the second substrate.

17. The PDP of claim 14, a reflectance of the main phosphor layers, the dummy phosphor layers, and the connector phosphor layers being less than a reflectance of the barrier ribs, the barrier ribs being white in color.

18. The PDP of claim 14, the second electrodes being address electrodes.

19. The PDP of claim 1, the main phosphor layers on the sidewall portions of the second barrier ribs being thicker than the dummy phosphor layers on the top portions of the second barrier ribs.

* * * * *